United States Patent [19]

Fowler et al.

[11] 4,284,990

[45] Aug. 18, 1981

[54] POSITION SENSING TRANSDUCER

[75] Inventors: Albert L. Fowler; Alan G. Henderson; Alastair K. Stevenson; David M. Walker, all of Fife, Scotland

[73] Assignee: Hughes Microelectronics Ltd., Glenrothes, Scotland

[21] Appl. No.: 126,583

[22] Filed: Mar. 3, 1980

Related U.S. Application Data

[63] Continuation-in-part of Ser. No. 21,876, Mar. 19, 1979, abandoned.

[30] Foreign Application Priority Data

Mar. 29, 1978 [GB] United Kingdom ..... 12300/78

[51] Int. Cl.[3] ..... G08C 9/04

[52] U.S. Cl. ..... 340/870.32; 340/870.18

[58] Field of Search ..... 340/870.32, 870.18; 307/354, 358; 328/124; 310/168

[56] References Cited

U.S. PATENT DOCUMENTS 3,161,803 12/1964 Knittweis ..... 310/68

*Primary Examiner*—Harold I. Pitts

*Attorney, Agent, or Firm*—John Holtrichter, Jr.; William H. MacAllister; Kenneth W. Float

[57] ABSTRACT

A displacement transducer suitable for monitoring the angular rotation of an internal combustion engine is provided. The transducer comprises a rotary disc having a castellated periphery and mounted for rotation with the engine. First and second coils are mounted such that upon operation of the engine the castellations of the disc interrupt the inductive coupling therebetween. The first coil is fed with an oscillatory electrical signal which induces in the second coil an output signal of a first peak amplitude during the interruptions produced by the castellations and of a second peak amplitude during periods between the interruptions. Thresholding circuitry responsive to the output signal produces a control signal which is indicative of the commencement and cessation of the interruptions. In accordance with one disclosed embodiment, the threshold circuitry includes a pair of inverters sharing the same thermal environment. The first inverter is capacitively coupled to receive the output signal from the second coil, and the second inverter, which has its output connected to its input in a feedback arrangement, provides bias through a resistive coupling to the first inverter to compensate for temperature drifts, whereby the first inverter switches output signal states when its input signal passes through a preselected voltage level.

21 Claims, 6 Drawing Figures

POSITION SENSING TRANSDUCER

CROSS-REFERENCE TO RELATED APPLICATIONS

This application is a continuation-in-part of application, Ser. No. 021,876, filed Mar. 19, 1979, now abandoned.

FIELD OF THE INVENTION

The present invention relates to an electrical displacement transducer which has particular but not exclusive application to use with an internal combustion engine, to provide an electrical signal indicative of the angular rotational position of the engine crankshaft, for use in controlling spark ignition of the engine.

BACKGROUND OF THE INVENTION

Conventionally, spark ignition of an internal combustion engine is controlled by mechanical contact breaker points which are operated by a rotary cam driven from the crankshaft of the engine. Timing of the spark ignition is controlled by moving the angular position of the contact breaker points relative to the cam's axis of rotation in dependence upon the level of partial vacuum obtaining in the inlet manifold to the engine.

Recently, electronic ignition systems for internal combustion engines have been developed. The electronic systems permit the timing of the spark ignition to be controlled in dependence not only upon the aforementioned vacuum level but also in dependence upon a plurality of other engine operating parameters and consequently permit the engine to operate more efficiently. The electronic ignition systems do not require the conventional contact breaker and cam arrangement, but some means is required to provide to the system an electrical signal indicative of the angular position of rotation of the engine in order that the system can control the timing of the spark ignition. Moreover, the angular position of rotation of the engine crankshaft needs to be monitored much more accurately than is possible with the conventional cam and contact breaker arrangement if the advantages of efficiency of engine operation made possible by the electronic ignition systems are to be maximized.

One prior art proposal for monitoring engine rotation is to fit to the flywheel of the engine, a series of permanent magnets accurately spaced apart around the periphery of the flywheel. The magnets are fitted in holes drilled in the flywheel. A pickup coil is mounted on the engine close to the flywheel such that upon rotation thereof each magnet induces an electrical pulse in the coil as the magnet passes the coil. Each pulse is thus indicative of the occurrence of a particular angular position of the engine. It is, however, difficult with this arrangement to achieve sharp pulses, as is required for an electronic ignition system, which indicate accurately when each of the magnets moves into alignment with the coil. This difficulty is due to the fact that, as a magnet approaches and passes the coil, a relatively long rise and fall of the induced pulse occurs, so that it is difficult to determine the peak of the pulse and hence the instance of alignment of the coil and magnet. In order to reduce but not overcome this difficulty, the coil is mounted as close as possible to the flywheel, typically less than 0.1 inch, which is difficult to achieve in practice without adding to the cost of the engine. It will also be appreciated that the required accurate drilling of the flywheel to fit the magnets adds significantly to the cost of the engine. Another difficulty with this prior art proposal is that in use thereof dirt tends to build up on the pickup coil, which causes the peak amplitude of the induced pulses to reduce with time as the dirt builds up, thereby making it difficult to use threshold circuits to improve the shape of the induced pulses. If a threshold circuit is used with a fixed threshold, the amplitude of the threshold must be relatively low in order to accomodate the reduction of pulse amplitude that will occur with time for the magnet induced pulses if the induced pulses are always to exceed the threshold. The relatively low thresehold accordingly provides for inaccurate results.

SUMMARY OF THE INVENTION

It is an object of the invention to provide a mechanically simpler and cheaper displacement transducer which has particular but not exclusive application to providing an electrical signal indicative of the angular position of rotation of an internal combustion engine.

It is a further object of the invention to provide a displacement transducer wherein the tolerance to which the component parts thereof need to be assembled is reduced substantially compared with prior art proposals aforesaid.

It is a further object of the invention to provide a displacement transducer for providing an output indicative of the angular position of rotation of the engine and which can be readily fitted to the engine.

It is another object of the invention or provide a displacement transducer wherein a slow build-up of dirt thereon will not deleteriously affect the accuracy thereof.

In accordance with the present invention, there is provided an electrical displacement transducer comprising spaced apart transmitting and receiving means for respectively transmitting energy and receiving the energy, and a member for being moved between the transmitting and receiving means. The member interrupts repetitively the passage of the energy from the transmitting means to the receiving means as the member is moved between the transmitting and receiving means. The receiving means produces an electrical output signal which assumes a first magnitude during the repetitive interruptions produced by the movable member, the output signal assuming a second different magnitude for periods between the interruptions. The output signal from the receiving means is fed to a circuit for producing an output indicative of when the output signal exceeds a magnitude representative of a predetermined portion, such as an average, of the first and second magnitudes whereby to provide an indication of the commencement and cessation of the interruptions. In one specific embodiment, a comparator is arranged to compare the magnitude of the output signal from the receiving means with the magnitude of a control signal representative of a predetermined portion, such as an average of the first and second magnitudes of the output signal. In a second specific embodiment, the output signal from the receiving means is applied through a capacitor to the input terminals of a pair of inverters which share the same thermal environment. A first one of the inverters provides a generally rectangular output pulse during the period that the signal applied thereto as greater than earth potential (nominally). The second inverter, which has its output connected to its input, provides bias potential to the first inverter so as to compensate for long term temperature drifts.

The transducer of the invention has the advantage that the signal produced thereby provides an accurate indication of the commencement and cessation of the interruptions produced by the movable member, even in the event of a change of the signal amplitude produced by a build-up of dirt on the transmitting or receiving means.

In the first embodiment, this advantage results from the fact that the output signal from the receiving means is compared in the comparator with a control signal representative of a predetermined portion, such as an average of the first and second magnitudes. A change in signal amplitude produced by a build-up of dirt may alter the first and second amplitudes of the output signal and which alters the value of the control signal accordingly. Thus the control signal effectively defines a variable threshold that alters automatically to take account of a build-up of dirt or other factors which alter the magnitude of the output signal from the receiving means.

In the second embodiment, switching midway between the first and second magnitudes is implemented by means which include the capacitor coupling that translates this midway level to a predetermined potential. Long term drifts in the in the "on-off" switching level of the first inverter, for example due to thermal causes, are compensated for by a bias potential applied to the first inverter by the second inverter. Since the two inverters are identical devices and subjected to the same thermal environment, the bias potential tracks out the shift in switching level experienced by the first inverter by insuring that the first inverter is biased at the switching level.

Preferably, the transmitting and receiving means comprise coils spaced apart for inductive coupling therebetween, and the movable member comprises a rotary disc having a castellated periphery, the coils being so positioned that upon rotation of the disc, the castellations thereof interrupt the inductive coupling between the coils. With this preferred arrangement, the disc can be mounted to rotate with the crankshaft of an internal combustion engine. The edges of the castellations can be positioned to define predetermined positions prior to top dead center for the respective pistons of the engine, so that in use, the signal produced by the comparator provides an indication of the positions, which can be used in an electronic ignition timing system as a reference for use in computing appropriate timings for ignition sparks.

The disc is an inexpensive component that can be made by stamping from an aluminum plate, and can be easily incorporated into the engine or can be bolted on to a member which rotates with the engine, such as the cooling fan. It will thus be appreciated that this preferred form of the transducer of the invention is an inexpensive arrangement which provides an accurate indication of the angular rotation of the engine. Moreover, a relatively wide spacing of typically 5 mm between the transmitting and receiving coils may be achieved without altering the accuracy of the transducer.

BRIEF DESCRIPTION OF THE DRAWINGS

In order that the invention may be more fully understood and readily carried into effect, two preferred embodiments of the invention are described hereinbelow by way of illustrative examples, and with reference to the accompanying drawings, in which.

DESCRIPTION OF THE PREFERRED EMBODIMENT

Figure 1:
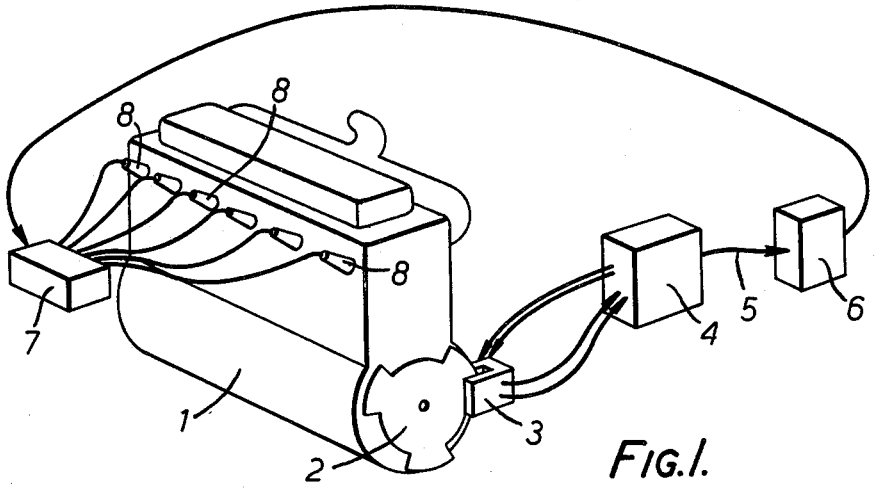
FIG. 1 is a schematic perspective view of an electrical displacement transducer of the present invention installed on an internal combustion engine.

Referring firstly to FIG. 1, there is shown a six cylinder automobile internal combustion engine 1 fitted with an electrical displacement transducer in accordance with the invention. The transducer comprises a member to be rotated by the engine, the member comprising a metal disc 2 mounted on the engine's crankshaft and having a castellated periphery. Mounted on the engine's casing is an electrical sensing arrangement 3 which provides electrical signals indicative of the angular position of rotation of the disc 2. The arrangement 3 is driven by electrical signals from a control circuit shown schematically at 4, and output signals from the arrangement 3 are fed to the circuit 4.

The circuit 4 provides signals on line 5 which are accurately indicative of the angular position of rotation of the disc 2. These signals are applied to a computing circuit 6 which uses the signals as a reference in computing the appropriate timing of ignition sparks for the engine, the timing being computed in response to sensed operating parameters of the engine. Such computing circuits are known, one such circuit being described in British Pat. No. 1,481,683.

The output of the computing circuit is applied to a spark generating and spark distributor arrangement 7 which may be of any of the well-known types and are not described in detail herein. The arrangement 7 feeds high voltage electrical sparks to conventional spark plugs 8 installed in the engine 1.

Figure 2:
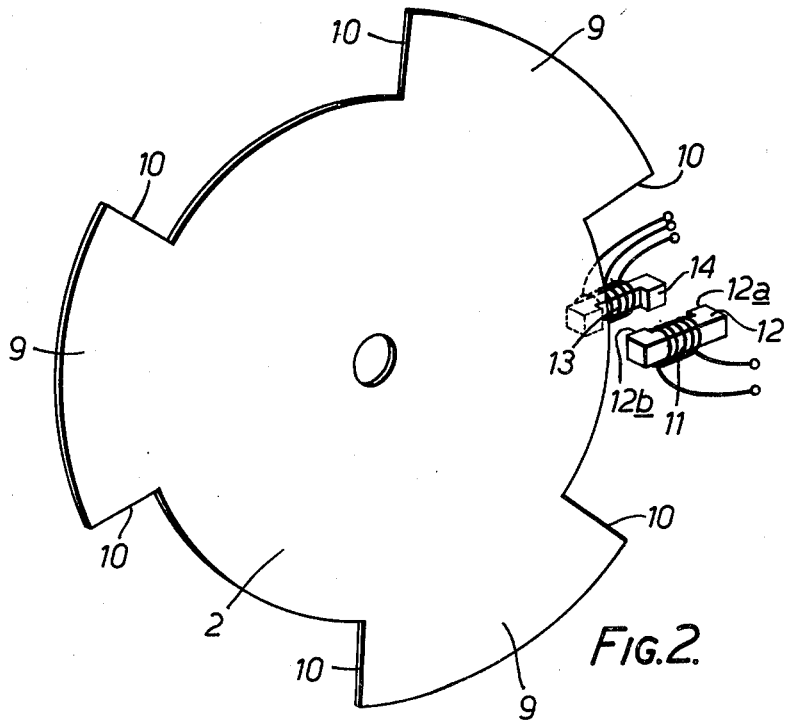
FIG. 2 is a perspective view in more detail of a part of the transducer shown in FIG. 1.

The disc 2 and the sensing arrangement 3 of the transducer are shown in a more detail in FIG. 2. The disc 2 has three castellations 9 which define six radially extending edges 10 each of which is for defining a predetermined position in the angular rotational cycle of the engine. More particularly, the edges are so arranged that as they pass the sensing arrangement 3, the appropriate edges define a predetermined angle prior to top dead center for the six pistons of the engine. The sensing arrangement 3 is arranged to to detect the passage of the edges 10 and comprises a transmitting means and a receiving means disposed on opposite sides of the disc 2. The transmitting means comprises a coil 11 which may be wound on a U-shaped ferrite core 12 having its pole pieces 12*a, b* disposed in a line extending radially of the disc. The receiving means comprises a similar arrangement, and in this example, a center-tapped coil 13 on a ferrite core 14.

As is explained in more detail hereinafter, the coil 11 is energized by an oscillatory electrical signal for inducing an electrical output signal in the coil 13. Upon rotation of the disc 2, the castellations 9 interrupt repetitively the passage of magnetic flux from the coil 11 to the coil 13. Thus the output signal induced in the coil 13, upon rotation of the disc 2, alternates between two peak amplitudes. The first is of a relatively small magnitude and occurs during the periods that the castellations 9 interrupt the inductive coupling between the coils 11, 13, and the second is of a relatively large magnitude and occurs for periods between the interruptions. Thus, it may be appreciated that the transitions between the two peak amplitudes in the signal induced in the coil 13, are indicative of the passage of the edges 10 of the disc 2 through the sensing arrangement 3. The control circuit 4 detects these transitions between the two peak signal amplitudes.

The control circuit 4 is described hereinbelow with reference to FIG. 3, and is shown therein in dotted outline. The control circuit 4 is driven by a system clock (not shown) which applies clock pulses to a terminal 15. The clock pulses typically are of a frequency of 100 kHz or greater and are fed to a drive circuit 16 which produces at the frequency of the clock pulses, a rectangular or sinusoidal waveform which is used to energize the coil 11. The waveform of the signal fed to the coil 11 is shown in FIG. 4*a*. The waveform of the signal induced in the coil 13 as the disc 2 is rotated, is shown in FIG. 4*b*. As described in more detail hereinbelow, the induced signal comprises the signal of FIG. 4*a*, amplitude modulated respectitively to a first peak signal amplitude while the castellations 9 interrupt the inductive coupling between the coils. The induced signal is further amplitude modulated to a second higher peak signal amplitude for periods between the interruptions produced by the castellations 9. It is also noted that at the transitions between the two peak signal levels, a finite rise or fall time occurs as a result of the time taken for the edges 10 to pass the coils 11, 13.

The modulated signal induced in the center-tapped coil 13 is fed on lines 17, 18 to a full wave demodulator 19 to remove the carrier frequency of the clock waveform and thereby derive a signal indicative of the amplitude modulation effected by rotation of the disc 2.

The demodulator 19 comprises two CMOS transmission gates 20, 21 connected to the lines 17, 18 respectively, and an inverter 22. The gate electrodes of the MOS transistors of the gates 20, 21 are driven either by the clock waveform or by an inverse thereof produced by the inverter 22, in such a manner as to recover the amplitude modulation envelope produced by rotation of the disc 2. In a first specific embodiment, the output of the demodulator 19 is fed to a filter comprising a resistor R1 and a capacitor C1 arranged to filter out harmonics produced by the demodulator.

The filtered output of the demodulator 19 is shown in FIG. 4*c* and this signal repetitively changes between a first signal level of a magnitude $V_1$ and a second signal level of magnitude $V_2$ each time one of the edges 10 of the disc passes between the coils 11, 13. The filtered output signal also has finite rise and fall times $t_r$, $t_s$ as the edges 10 pass between the coils 11, 13.

In order to detect the timing of the transitions in the waveform of FIG. 4*c* accurately, the filtered output of the demodulator 19 is fed to one input of a differential amplifier 24 or comparator which operates as a squaring comparator. The other input of the amplifier 24 receives a DC level $V_a$ produced from the output of the demodulator by a filtering network comprising a resistor R2 and a capacitor C2. The DC level $V_a$ is arranged to be a predetermined portion, such as an average of the magnitudes of the signal levels $V_1$, $V_2$ and is preferably related as follows:

$$V_a = \tfrac{1}{2}(V_1 + V_2)$$

Thus, the amplifier 24 will only produce an output on line 23 when the signal level shown in FIG. 4*c* exceeds the magnitude $V_a$, which results in a rectangular waveform on line 23 as shown in FIG. 4*d*. The leading and trailing edges of the rectangular waveform are accurately indicative of the passage of the edges 10 of the disc 2 between the coils 11, 13, since the magnitude of the filtered output of the demodulator 19 becomes equal to $V_a$ half way through the rise times $t_r$, $t_s$. The arrangement of the amplifier 24 and the averaging filter network R2, C2 provides a substantial advantage in that the timing of the leading and trailing edges of the pulses of the waveform of FIG. 4*d* is not deleteriously affected by long term drifts in the magnitudes of $V_1$ and/or $V_2$. The filtered output from the demodulator 19 is always compared with an average of $V_1$ and $V_2$, and the average is be commensurately affected by the long term drifts in $V_1$ and/or $V_2$. Thus, the leading and trailing edges of the waveform of FIG. 4*d* occur substantially midway through the transitions between $V_1$ and $V_2$.

Figure 5:
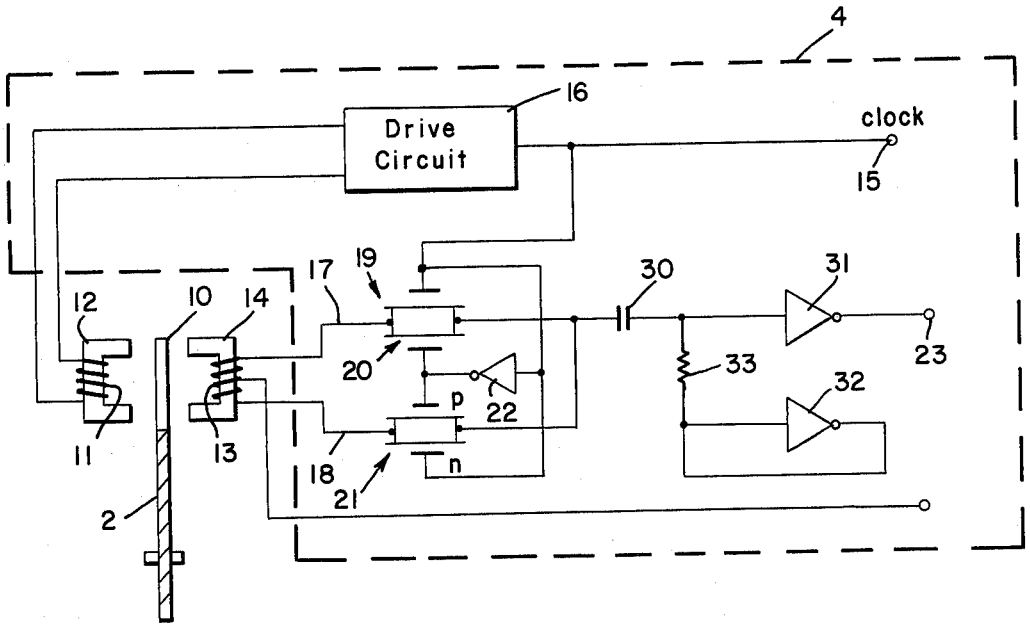
FIG. 5 shows a second embodiment of the transducer.

In a second specific embodiment, shown in FIG. 5, the output of the demodulator 19 is connected to one end of a capacitor 30, whose other end is connected to the input of a first CMOS inverter 31 and one end of a resistor 33. The output of the first inverter 31 is the system output 23. The other end of the resistor is connected to the input and the output of a second CMOS inverter 32. The first and second inverters 31, 32 have substantially the same thermal environment and substantially the same electrical characteristics.

Figure 3:
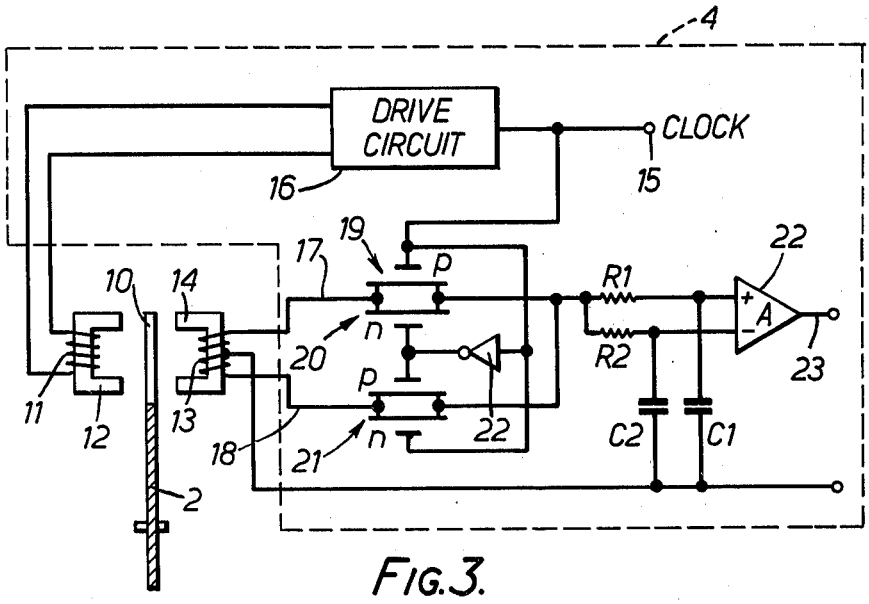
FIG. 3 is a schematic circuit diagram of a first embodiment of the transducer.
Figure 4:
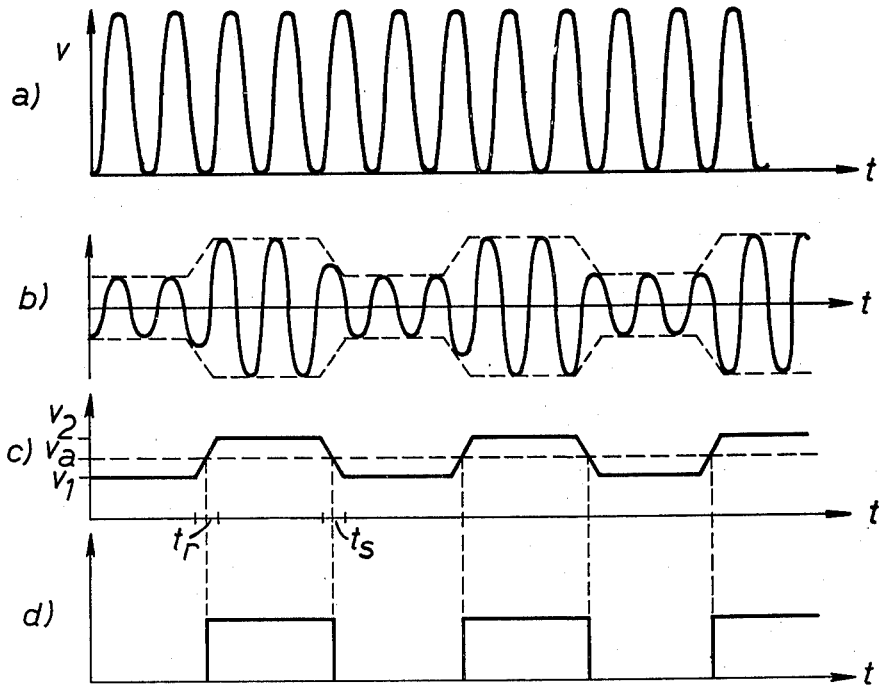
FIG. 4 illustrates several electrical waveforms developed in use of the circuit of FIG. 3.
Figure 6:
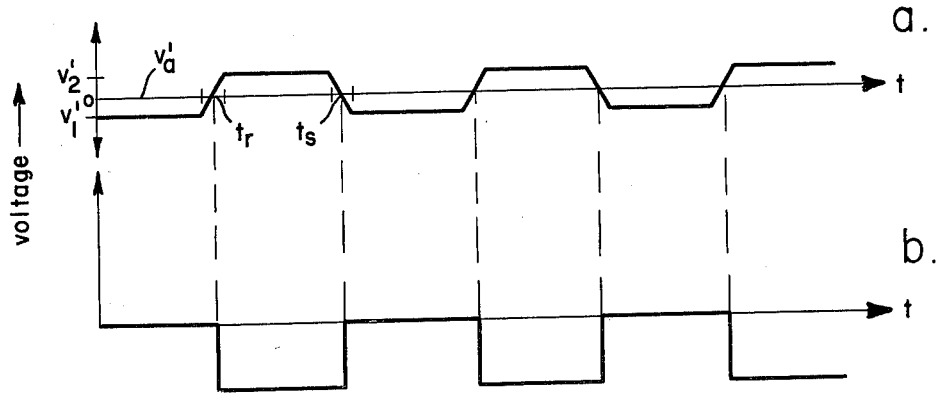
FIG. 6 shows two electrical waveforms developed in use of the circuit of FIG. 5.

FIGS. 6*a* and 6*b* show waveforms associated with the second specific embodiment, which correspond to the waveforms of FIGS. 4*c* and 4*d* respectively of the first specific embodiment (FIG. 3). In operation of the second embodiment of FIG. 5, the capacitor 30 receives on its left hand side the waveform of FIG. 4*c*, and the waveform at the right side is that of FIG. 6*a* which is shifted so as to be symmetrically disposed about an intermediate potential defined by the second inverter 32 in its feedback condition. The nominal level at which the first inverter 31 switches is at the predetermined potential defined by the second inverter 32, and it provides an output each time the output of capacitor 30 passes through the predetermined potential, and as such produces the output of FIG. 6*b*. Thus, the first inverter 31 is biased to switch at the average voltage $V_a'$ of $V_1'$ and $V_2'$.

The second inverter 32 is connected in a closed loop to compensate for long term drifts in the switching threshold of the first inverter 31. Generally, a CMOS inverter connected in a closed loop produces a voltage indicative of its switching threshold. Since the first and second inverters 31, 32 share the same thermal environment, their switching thresholds are approximately the same, the effect of the second inverter 32 is to apply an appropriate compensating bias voltage to the input of the first inverter 31. This insures that the first inverter 31 is always biased close to its predetermined switching level notwithstanding long term drifts.

To summarize the operation of the second embodiment, output signal from the demodulator 19 is applied through the capacitor 30 to the input terminals of the inverters 31, 32 which share the same thermal environment. The first inverter 31 provides a generally rectangular output pulse during the period that the applied signal is greater than the predetermined potential. The second inverter 32 which has its output connected to its input provides bias potential to the first inverter 31 so as to compensate for long term drifts. In the second embodiment, switching midway between the first and second magnitudes is implemented by the capacitor 30 coupling which references this midway level to the predetermined potential. Long term drifts in the "on-off" switching level of the first inverter 31, for example due to thermal causes, are compensated for by a bias potential applied to the first inverter 31 by the second inverter 32. Since the two inverters are identical devices and subjected to the same thermal environment, the bias potential tracks out the shift in switching level experienced by the first inverter 31 by insuring that the first inverter 31 is biased just below the switching level.

Also, it will be noted that variations in the frequency of the clock waveform applied to terminal 15 does not affect substantially the accuracy of the output on line 23.

Moreover, the design of the filter network C2, R2 of the first embodiment (FIG. 3) may be arranged so that the transducer operates accurately over the normal range of engine speeds associated with an internal combustion engine.

The control circuits of FIGS. 3 and 5 also have the advantage that they may readily be formed by CMOS integrated circuit techniques and may be integrated into the circuit component(s) of the computing circuit 6.

While in the described embodiment, the transmitting and receiving means comprise coils arranged in ferrite cores, other devices such as an LED and a photodetector could be used. However, we especially prefer to use the described coil arrangement because it permits a wide spacing of typically 5 mm between the cores, is not affected substantially by dirt or other accumulated deposits thereon, and is capable of withstanding the vibration, shock and temperature variations that occur in the vincinity of an internal combustion engine.

While the above-described embodiments of the invention are used in an engine spark ignition system, the transducers have other applications and can be used, for example, in fuel injection, exhaust gas recirculation and other engine management systems.

We claim:

1. An electrical displacement transducer comprising:

spaced apart transmitting and receiving means for respectively transmitting energy and receiving said energy;

a member for being moved between said transmitting and receiving means, said member interrupting repetitively the passage of said energy from the transmitting means to the receiving means as a function of the movement of the member between said means;

said receiving means producing an electrical output signal which assumes a first magnitude during said repetitive interruptions and a second different magnitude for periods between said interruptions;

means responsive to said output signal for producing a control signal of a magnitude which is representative of an average of said first and second magnitudes; and a comparator arranged to compare the magnitude of said output signal with the magnitude of said control signal and provide a signal indicative of the commencement and cessation of said interruptions.

2. An electrical displacement transducer in accordance with claim 1 wherein said member comprises a rotary disc having a castellated periphery, the transmitting and receiving means being so positioned that upon rotation of the disc the castellations thereof produce said repetitive interruptions.

3. An electrical displacement transducer in accordance with claim 2, wherein said transmitting and receiving means comprise coils spaced apart from one another for inductive coupling therebetween.

4. An electrical displacement transducer in accordance with claim 3 wherein said transmitting means includes a drive circuit arranged to feed an oscillatory electrical signal to one of said coils, and said receiving means includes a demodulator connected to receive the signal induced in the other of said coils and arranged to provide a demodulated signal indicative of an amplitude modulation effected by movement of said member to the signal induced in said second coil.

5. An electrical displacement transducer in accordance with claim 4, wherein said drive circuit has an input to receive clock pulses, said drive circuit producing said oscillatory signal at a frequency controlled by the frequency of said pulses, and said demodulator is connected to receive said clock pulses.

6. An electrical displacement transducer in accordance with claim 5, wherein said demodulator comprises CMOS transmission gates, the gate electrodes of the transistors thereof being connected to receive said clock pulses or the inverse thereof.

7. An electrical displacement transducer in accordance with claim 4, 5 or 6 and wherein said means for producing a control signal includes a filtering network connected to a demodulator and arranged to produce said control signal.

8. An electrical displacement transducer in accordance with claim 7, wherein the comparator comprises a differential amplifier having a first input connected to receive said control signal from said filtering network and having a second input connected to receive the demodulated signal from the demodulator.

9. An internal combustion engine provided with a displacement transducer for monitoring the angular rotation of the engine, the displacement transducer comprising:

a rotary disc provided with a castellated periphery and mounted for rotation with the engine;

first and second coils mounted on the engine, said coils being spaced apart from one another for inductive coupling therebetween and such that upon rotation of the engine the castellations of the disc interrupt said coupling;

means arranged to supply to a first of said coils an oscillatory electrical signal whereby to induce in the second of said coils an output signal of a first peak amplitude during the said interruptions produced by said castellations of the disc and of a second peak amplitude during periods between said interruptions;

means responsive to said output signal for producing a control signal of a magnitude which is representative of an average of said first and second magnitudes; and a comparator arranged to compare the peak magnitude of said output signal with said control signal whereby to provide an indication of the commencement and cessation of said interruptions.

10. An electrical displacement transducer comprising:

spaced apart transmitting and receiving means for respectively transmitting energy and receiving said energy;

a member for being moved between said transmitting and receiving means, said member interrupting repetitively the passage of said energy from said transmitting means to said receiving means as a function of the movement of said members between said means;

said receiving means producing an electrical output signal which assumes a first magnitude during said repetitive interruptions and a second different magnitude for periods between said interruptions; and output means for producing an output indicative of when said signal exceeds a magnitude representative of an average of said first and second magnitudes whereby to provide an indication of the commencement and cessation of said interruptions.

11. An electrical displacement transducer in accordance with claim 10 wherein said member comprises a rotary disc having a castellated periphery, the transmitting and receiving means being so positioned that upon rotation of the disc the castellations thereof produce said repetitive interruptions.

12. An electrical displacement transducer in accordance with claim 10 or 11, wherein said transmitting and receiving means comprise coils spaced apart from one another for inductive coupling therebetween.

13. An electrical displacement transducer in accordance with claim 12 wherein said transmitting means includes a drive circuit arranged to feed an oscillatory electrical signal to one of said coils, and said receiving means includes a demodulator connected to receive the signal induced in the other of said coils and arranged to provide a demodulated signal indicative of an amplitude modulation effected by movement of said member to the signal induced in said second coil.

14. An electrical displacement transducer in accordance with claim 13, wherein said drive circuit has an input to receive clock pulses, said drive circuit producing said oscillatory signal at a frequency controlled by the frequency of said pulses, and said demodulator is connected to receive said clock pulses.

15. An electrical displacement transducer in accordance with claim 14, wherein said demodulator comprises CMOS transmission gates, the gate electrodes of the transistors thereof being connected to receive said clock pulses or the inverse thereof.

16. The electrical displacement transducer of claims 13, 14 or 15 wherein said output means comprises means responsive to said signal from said receiving means for producing a control signal of a magnitude which is representative of an average of said first and second magnitudes, and a comparator arranged to compare the magnitude of said signal from said receiving means with the magnitude of the control signal so as to provide said output.

17. The electrical displacement transducer of claims 13, 14 or 15 wherein said output producing means comprises a capacitor connected to first and second inverters which share the same thermal environment, said first inverter providing an output of the same general shape as provided to said capacitor by said demodulator, but which is shifted to a predetermined potential, said second inverter controlling the switching threshold of said first inverter so as to compensate for long term temperature drifts of said transducer.

18. The transducer of claim 17 wherein said first and second inverters are CMOS inverters.

19. An electrical displacement transducer in accordance with claim 16, wherein the comparator comprises a differential amplifier having a first input connected to receive said control signal from said filtering network and having a second input connected to receive the demodulated signal from the demodulator.

20. An electrical displacement transducer in accordance with claim 19 wherein the comparator comprises a differential amplifier having a first input connected to receive said control signal from said filtering network and having a second input to receive the demodulated signal from said demodulator.

21. An electrical displacement transducer comprising:

spaced apart transmitting and receiving means for respectively transmitting energy and receiving said energy;

a member for being moved between said transmitting and receiving means, said member interrupting repetitively the passage of said energy from said transmitting means to said receiving means as a function of the movement of said members between said means;

said receiving means producing an electrical output signal which assumes a first magnitude during said repetitive interruptions and a second different magnitude for periods between said interruptions; and output means for producing an output indicative of when said signal exceeds a magnitude representative of a predetermined portion of said first and second magnitudes whereby to provide an indication of the commencement and cessation of said interruptions.

* * * * *